United States Patent [19]

Collins

[11] Patent Number: 4,854,485

[45] Date of Patent: Aug. 8, 1989

[54] PISTONS FOR PRESSURE-DISPENSING CONTAINERS

[75] Inventor: Malcolm G. Collins, Wantage, United Kingdom

[73] Assignee: Metal Box p.l.c., Reading, United Kingdom

[21] Appl. No.: 118,406

[22] Filed: Nov. 9, 1987

[30] Foreign Application Priority Data

Nov. 12, 1986 [GB] United Kingdom ..... 8626945

[51] Int. Cl.[4] ..... B67D 5/42

[52] U.S. Cl. ..... 222/386; 222/327

[58] Field of Search ..... 222/386, 386.5, 389–391, 222/326–327; 53/489; 220/93

[56] References Cited

U.S. PATENT DOCUMENTS

| | | | |
|---|---|---|---|
| 2,923,442 | 2/1960 | Maras | 222/391 X |
| 3,319,841 | 5/1967 | Berg | 222/327 X |
| 3,378,175 | 4/1968 | Krieps | 222/327 |
| 4,179,050 | 12/1979 | Farrell, III et al. | 222/386 |
| 4,331,267 | 5/1982 | Duncan et al. | 222/386 X |

FOREIGN PATENT DOCUMENTS

| | | | |
|---|---|---|---|
| 4100 | 9/1979 | European Pat. Off. | 222/327 |
| 0081145 | 6/1983 | European Pat. Off. . | |
| 2034047 | 8/1971 | Fed. Rep. of Germany . | |
| 2920915 | 11/1980 | Fed. Rep. of Germany . | |
| 1302981 | 1/1973 | United Kingdom . | |
| 1329108 | 9/1973 | United Kingdom . | |
| 1428009 | 3/1976 | United Kingdom . | |
| 1464423 | 2/1977 | United Kingdom . | |
| 1475430 | 6/1977 | United Kingdom . | |
| 2049062 | 12/1980 | United Kingdom . | |
| 1588406 | 4/1981 | United Kingdom . | |
| 2064012 | 6/1981 | United Kingdom . | |
| 2070695 | 9/1981 | United Kingdom . | |
| 2071268 | 8/1983 | United Kingdom . | |
| 1133988 | 11/1986 | United Kingdom . | |

*Primary Examiner*—Michael S. Huppert

*Attorney, Agent, or Firm*—St. Onge, Steward, Johnston & Reens

[57] ABSTRACT

A piston for a pressure-dispensing container such as a cartridge for an extrusion gun has its closure panel formed of a central portion (34) arranged to receive the applied extrusion forces, and an annular and frustoconical outer portion (40) arranged to transmit the extrusion forces to the piston skirt (30) with an outwardly directed component by which the skirt is radially expanded to make firm sealing engagement with the container bore. The central portion is rigid so as to withstand the extrusion forces without any substantial distortion; the outer portion acts as a substantially rigid annular strut, notches (44) localizing any bending movements to the junctions of the outer portion with the central portion and with the skirt.

22 Claims, 3 Drawing Sheets

PISTONS FOR PRESSURE-DISPENSING CONTAINERS

This invention relates to pistons for pressure-dispensing containers, in particular for cartridges for extrusion guns.

An ever-increasing range of viscous and fluid products is being packaged in hollow cylindrical cartridges, of generally plastics or board material, which are closed by an axially movable piston at one end and have (or are capable of receiving) a nozzle at their other end through which product can be expelled by pressure applied to the piston by the push rod of an extrusion gun. Mastic sealants and gap-filling products for the construction industry are one group of substances for which this method of application has found particular favour. The piston is injection-moulded from a suitable thermoplastics material and essentially comprises a closure panel generally corresponding in cross-sectional dimensions to the cartridge, and a tubular skirt which extends backwardly from attachment to the closure panel periphery and which is arranged to provide sealing and guidance by engagement with the bore of the cartridge body.

A particular problem encountred with many of the cartridges currently available is that of substantial leakage of product past the piston during dispensing. In an attempt to prevent or substantially reduce the leakage it has been proposed to so design the piston that axially directed pressure applied by the extrusion gun causes the skirt around the closure panel to expand into tight-fitting engagement with the cartridge body.

There are two basic types of such expanding pistons known to Applicants; in one type, exemplified by the closure described and claimed in British Patent Specification 1302981, the piston has, in addition to the closure panel and the skirt, a generally rigid and frustoconical abutment lip which is attached at the junction of the closure panel with the skirt, and which from there extends inwardly and backwardly within the piston interior to a free edge. Pressure engagement of this free edge by the push rod of the extrusion gun during dispensing creates a radially outwardly directed component of force by which the skirt around the closure panel is expanded into firm sealing engagement with the cartridge body.

In the second type of expanding piston known to Applicants, the closure panel is concavely domed backwardly towards the piston interior so as to meet the skirt at an acute angle similar to that made by the abutment lip in Patent Specification 1302981 discussed above. Pressure engagement of a central portion of the domed closure panel by the push rod of the extrusion gun causes a free annular margin of the closure panel around its engagement with the push rod to act functionally in the manner of the abutment lip of Specification 1302981, with the result that the skirt is again expanded around the periphery of the closure panel for the purpose of increasing the effectiveness of the seal formed with the cartridge body.

However, both of the types of expandable piston described above have shortcomings. The first type, with the frustoconical abutment lip, requires a relatively complicated and therefore expensive mould with radially movable parts, and may require the attachment of a stiffening cover member to reduce leakage of low viscosity products. The second type of expandable piston, with the backwardly domed closure panel, may be subject to substantial leakage even with products of relatively high viscosity; applicants believe that this leakage may be due to distortion of the skirt caused by referred random distortion of the closure panel at its engagement with the push rod of the extrusion gun.

Applicants have sought by the present invention to provide a piston which is expandable for improved sealing and yet which not only may be easy and cheap to mould but also may of itself be substantially leakage-free in operation even when subject to large extrusion forces. In accordance with the present invention there is therefore provided a thermoplastics piston for a pressure-dispensing container, which comprises a closure panel, and a tubular skirt which extends generally in a backward direction from attachment to the closure panel periphey and is adapted to provide sealing and guidance for the piston by engagement with the bore of a said container in which the piston is received, wherein the closure panel has a central portion, and an annular portion connecting the central portion peripherally to the skirt, the central portion being rigid so as without any substantial distortion to withstand axially directed extrusion forces imposed on it for dispensing product from the container, and the annular portion being inclined and extending forwardly and outwardly towards the skirt so as to transmit the extrusion forces to the skirt with a radially outward component by which the skirt may be expanded into sealing engagement with the container.

Advantageously, around the periphery of the closure panel the skirt is formed with an outwardly projecting, generally cylindrical land at which to make the said sealing engagement with the container. Using such lands having an axial length of at least 2 mm (preferably between 2.5 mm and 3.5 mm) and a cross-sectional dimension which nominally is between 0.25 mm and 0.5 mm greater than the corresponding cross-sectional dimension of the container bore, Applicants have been able to dispense fluid substances having a viscocity similar to that of water without any substantial leakage past the piston. A preferred axial length for the land is about 3 mm, and a preferred degree of interference is about 0.375 mm on diameter.

When the piston is first introduced into the container after the filling of the container with product, it is desirable to prevent entrapment of air in front of the piston which might interfere with the dispensing operation. This can be achieved in a conventional manner by wires or fingers along which the piston is forced into the container and which provide vent channels until their removal after the piston has been inserted. As an alternative, however, for a piston having a land as discussed in the preceding paragraph, the land may be formed with one or more short interruptions or grooves through which air can pass for venting but which is of sufficiently small cross-sectional area to prevent any substantial escape of product therethrough.

Furthermore, and as in the embodiment of the invention now to be described, any product which does escape through the venting interruption(s) or groove(s) is preferably collected by one or more segments of an interrupted collection and guidance ring which is formed on the skirt adjacent its free trailing edge. The ring need not be required to provide any sealing function for the piston, and its segments may therefore be widely spaced apart.

The above and other aspects and features of the invention will become apparent from the following description of a piston embodying the invention, now to be given by way of example and with reference to the accompanying drawings.

In the drawings:

FIG. 1 diagrammatically shows the piston as it would appear when in position in a cartridge for an extrusion gun, prior to a dispensing operation;

Figure 1:
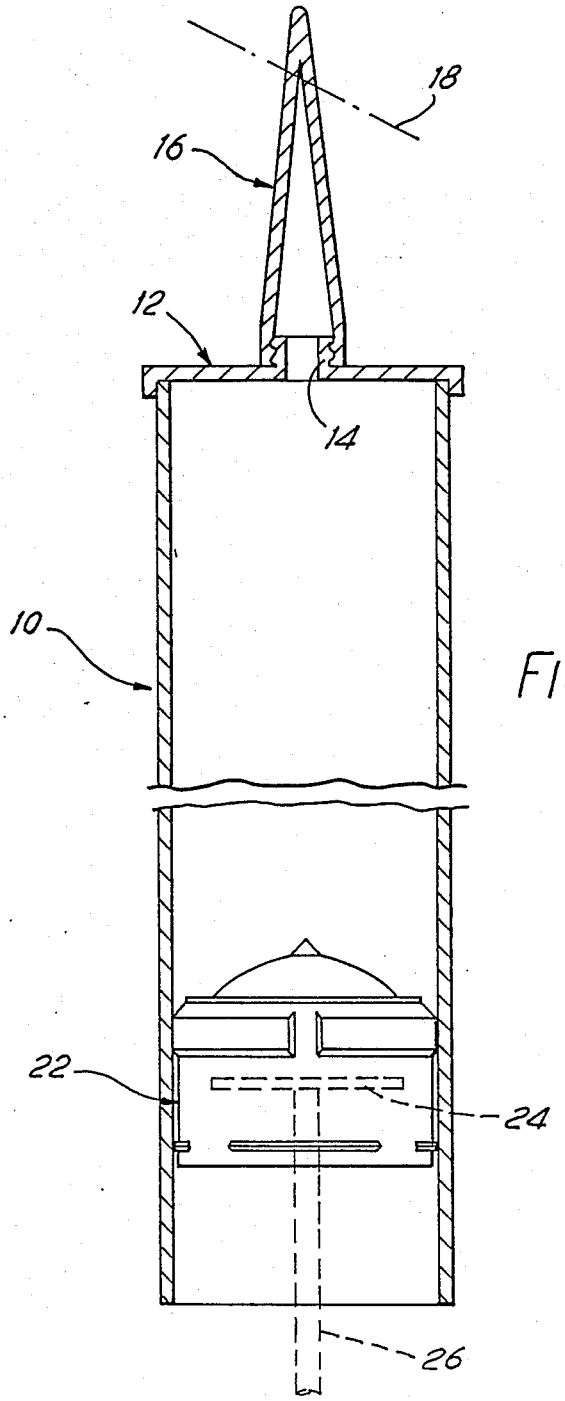

Referring firstly to FIG. 1, a cartridge for an extrusion gun comprises a tubular body 10 which may be made, for example, of helically wound board or from an extruded thermoplastics material such as high density polyethylene. One end of the body is closed by a metal or plastics headpiece 12 which is suitably attached to the body, for example by clinching, seaming or spin-welding. The headpiece has a screw-threaded and apertured central boss 14 onto which an elongate, tapering nozzle 16 for the cartridge is screwed. The nozzle shown is moulded from thermoplastics material, and for use it is severed adjacent its pointed end such as along the inclined severance line 18 shown. The boss may be closed, and its top end severed prior to the attachment of the nozzle Typically, the product in the cartridge is a mastic sealant compound for construction or home improvement use.

The end of the cartridge body 10 opposite the nozzle 16 is closed by a piston 22 which makes sealing engagement with the bore of the body as will shortly be described. For dispensing product the piston is engageable by the generally flat pusher plate 24 on the end of the push rod 26 of an extrusion gun. The extrusion gun may be conventional, and is therefore not shown in full.

Figure 2:
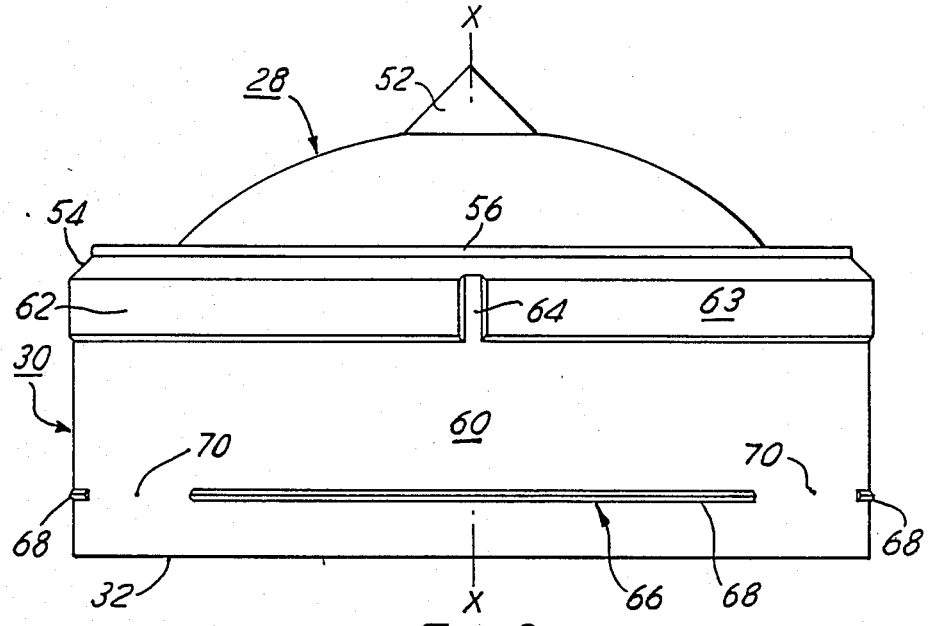
FIG. 2 shows the piston in side elevation and to an enlarged scale.
Figure 4:
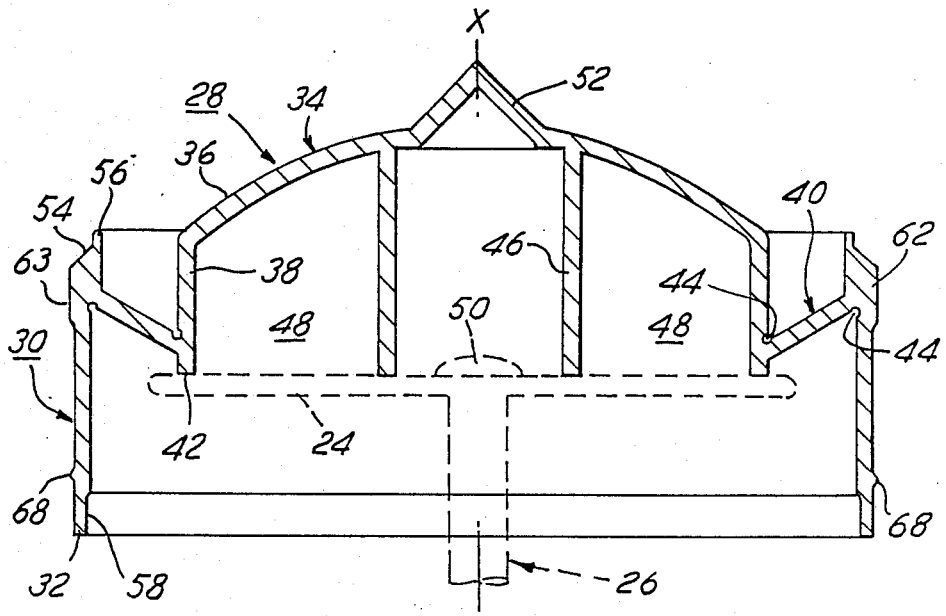
FIG. 4 is a sectional elevation of the piston when engaged by the push rod of the extrusion gun and as seen on the line IV—IV of FIG. 3.
Figure 3:
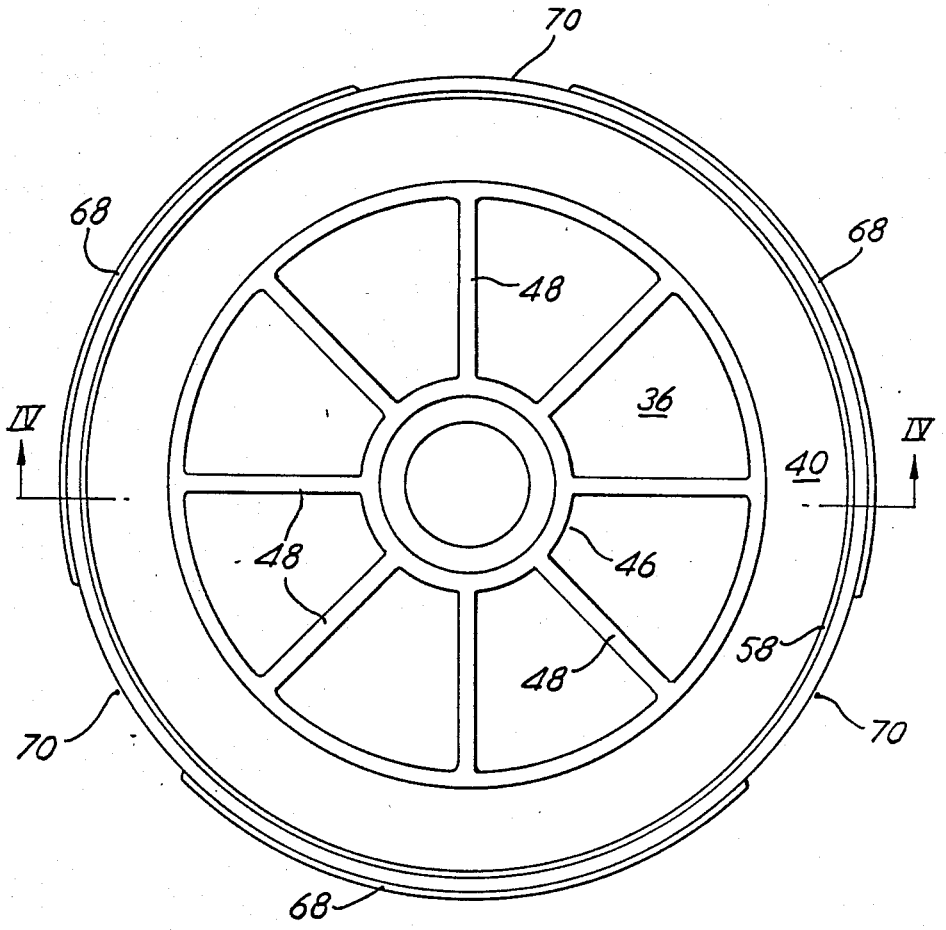
FIG. 3 is a corresponding plan view of the piston as seen from behind, that is to say, as it is presented to the push rod of the extrusion gun.

FIGS. 2 to 4 show the arrangement of the piston in greater detail. It is a unitary injection-moulding of a suitable thermoplastics material such as polypropylene or high density polyethylene, and comprises a circular closure panel 28 and a cylindrical skirt 30 which extends generally in a backwards direction to a free edge 32 from connection around the periphery of the closure panel.

The closure panel 28 has a forwardly projecting central portion 34 with a domed front panel 36 merging into a cylindrical side wall 38, and a frustoconical outer porton 40 which surrounds the central portion 34 as an annulus, and which joins the central portion on its inside with the skirt 30 on its outside.

The inner junction of the outer portion 40 with the central portion 34 is made at the side wall 38 a small distance along the side wall from its free edge 42. From its junction with the side wall the outer portion extends forwardly and outwardly, at an angle of about 60° to the piston axis XX, to the outer junction which it forms with the skirt 30. In order to encourage articulation at the two junctions for the purpose later to become apparent, the plastics material of the piston is locally thinned by means of notches 44 moulded around the acute angles of the junctions as shown.

In addition to the front panel 36 and the side wall 38, the central portion 34 of the closure panel has a tubular hub 46 lying concentrically within the side wall, and eight axially and radially dircted reinforcing struts 48 which join the hub with the side wall at regular intervals around the piston.

The hub 46 and the reinforcing struts 48 are integrally joined to the front panel 36 at their front ends. At their rear ends they terminate in free edges (not separately referenced) which lie on the same transverse plane as the free edge 42 of the side wall 38. The central portion 34 as a whole is therefore essentially rigid and capable of withstanding, without distortion, the substantial extrusion forces which may be imposed on it by the extrusion gun. Furthermore, it presents a plane rear face at which the pusher plate 24 of the extrusion gun may engage as is indicated in FIG. 4; the hub 46 then accommodates any central projection 50 which may exist at the front of the pusher plate.

The front panel 36 has a conical boss 52 formed centrally within the confines of the hub 46. The boss assists in reducing the product residue which is unavoidably left in the cartridge after dispensing has been completed; it also facilitates orientation of the piston for automatic insertion into the cartridge.

The skirt 30 is generally cylindrical and extends backwardly to the free edge 32 from its junction with the outer portion 40. It has a forwardly and inwardly inclined, frustoconical front surface 54 to aid the initial insertion of the piston into the cartridge. In order to enable the piston to be stacked in a stable manner with other such pistons for convenience of transport and storage, a forwardly projecting bead 56 is formed around the inner periphery of the surface 54 and dimensioned for push-fit engagement with the skirt of the piston in front; such engagement by a bead 56 occurs at an enlargement 58 of the bore of the skirt 30 in the locality of its free edge 32.

The outside surface 60 of the skirt 30 is generally right cylindrical and has nominally the same diameter as the bore of the cartridge in which the piston is to be inserted. At its forward end, however, the piston is formed with an outwardly projecting land 62 of generally rectangular cross-sectional, which is dimensioned to be a substantial interference fit within the cartridge bore at its cylindrical outer surface 63.

For venting any air which may be trapped in front of the piston when it is inserted into the cartridge by the packer, the land 62 is formed with three regularly spaced, peripherally short interruptions 64. In the embodiment shown, these interruptions extend for the full depth of the land to the surface 60; for some applications, however, it may be preferable for the interruptions to be in the form of grooves which do not extend to the surface 60.

At the backward end of the piston the skirt 30 has a collection and guidance ring 66 formed of three segments 68. The segments are spaced regularly around the skirt and separated by spaces 70. They are of generally triangular cross-section and stand proud of the surface 60 so as to provide positive guidance for the piston as it moves along the cartridge during dispensing; in addition, the segments 68 are axially centred on the interruptions 64 of the land 62 so as to collect any product which during dispensing may escape through the interruptions and be left on the bore of the cartridge behind the piston. The collection and guidance ring is not required to perform any sealing function.

In operation of the piston 22 for dispensing product from the nozzle 16 (FIG. 1), axial force applied to the central portion 34 of the piston by the push rod 26 drives the piston in known manner progressively along the cartridge as dispensing proceeds; the piston presents a generally convex exterior to the product, and the amount of product residue unavoidably left when dispensing has been completed is correspondingly small.

By virtue of the inclination of the outer portion 40 of the closure panel 28, the force which is generated by the push rod and transmitted to the skirt 30 from the central portion 34 includes a radially outwardly directed component. In response to this component of force, the skirt around the outer portion is locally expanded to force the land 62 into tighter sealing engagment with the cartridge generally in proportion to the applied extrusion force.

As previously mentiond, the central portion is capable of bearing the extrusion force without any substantial distortion; in addition, with the assistance of the notches 44 (which define hinges to encourage bending at its junctions with the central portion 34 and with the skirt 30), the outer portion is capable of acting as a substantially rigid annular strut which transmits the extrusion forces to the skirt without buckling. The radially outward forces imposea on the skirt are therefore distributed substantially evenly around the piston periphery and have little or no tendency to cause ovality or other distortion over the transverse cross-section of the skirt. It is believed that the angle of inclination of the outer portion to the central axis of the piston should advantageously be within the range 45° to 70°, about 60° being preferred.

Also contributing to the substantially leak-proof nature of the piston described and shown is the arrangement of the land 62. The land is positioned and dimensioned so as to span the junction of the skirt 30 with the outer portion 40, and from there extends axially for a substantial distance in each direction. In addition, the land is arranged to make a substantial degree of interference with the bore of the cartridge. Typically, for a cartridge having an outside diameter of 47 mm, the land has a length of about 3.2 mm and is arranged to make about 0.375 mm nominal interference (on diameter) with the cartridge wall; the outer portion 40 has a thickness of about 1.2 mm axially of the piston, and the land is disposed centrally in relation to it.

Although it is preferred, a piston in accordance with the invention may be arranged to seal against the cartridge wall other than at a land such as the land 62 described and shown. For example, sealing may be effected by one or more ribs or beads of short axial length. The sealing formation or formations provided may be interrupted or formed with grooves for venting purposes as particularly described, although this is not essential. Using a piston with a sealing formation identical to the land 62 but lacking any interruptions 64, Applicants have been able to dispense products having a similar viscosity to water without substantial leakage.

Although particularly described in relation to cartridges for extrusion guns, the invention may have application to pistons for other pressure-dispensing containers, that is to say, containers which are adapted to dispense a fluid or viscous product by means of pressure generated by the piston.

I claim:

1. A thermoplastics piston for a pressure-dispensing container, which comprises a closure panel, and a tubular skirt which extends generally in a backward direction from integral attachment to the closure panel periphery and has an external surface which surrounds said integral attachment of said skirt with said closure panel in axial correspondence therewith and which is adapted to provide sealing and guidance for the piston by engagement with the bore of a said container in which said piston is received, wherein said closure panel has a central portion for receiving axially directed extrusion forces imposed on the piston for dispensing product from said container, and an annular portion connecting said central portion peripherally to said skirt, said central portion having a front face for contact with the product and being rigid so as to withstand said axially imposed extrusion forces and the resultant reaction forces of the product without any substantial distortion thereof, said annular portion having a dimension radially of said piston substantially less than the corresponding dimension of said central portion, and said annular portion being inclined and extending forwardly and outwardly towards said skirt so as to transmit the said extrusion forces to said skirt with a radially outward component by which said skirt may be expanded to bring its said external surface into sealing engagement with said container.

2. A piston according to claim 1, wherein the central portion has a hollow and forwardly domed peripheral wall and is formed within its interior with a hollow central hub and a plurality of axially directed reinforcing struts joining the hub with the peripheral wall.

3. A piston according to claim 2, wherein the peripheral wall, the hub and the reinforcing struts terminate at coplanar free edges arranged for engagement by a generally plane pusher plate.

4. A piston according to claim 2 wherein the peripheral wall is centrally formed with a forwardly projecting conical boss.

5. A piston according to claim 1 wherein the inclination of the annular portion to the axis of the piston lies within the range 45° to 70°.

6. A piston according to claim 1 wherein the inclination of the annular portion to the axis of the piston is about 60°.

7. A piston according to claim 1 which has respective notches formed around the acute angles between the annular portion and the central portion, and between the annular portion and the skirt, to encourage articulation at those junctions.

8. A piston according to claim 1 wherein for making sealing engagement with the container bore the skirt is formed with one or more outwardly projecting sealing formations which extend at least substantially continuously therearound.

9. A piston according to claim 1 wherein for making sealing engagement with the container bore the skirt is formed with a single outwardly projecting sealing formation which extends at least substantially continuously therearound, the sealing formation being a generally cylindrical land having an axial length of at least 2 mm.

10. A piston according to claim 1 wherein for making sealing engagement with the container bore the skirt is formed with a single outwardly projecting sealing formation which extends at least substantially continuously therearound the sealing formation being a generally cylindrical land having an axial length within the range of 2.5 mm to 3.5 mm.

11. A piston according to claim 1 wherein for making sealing engagement with the container bore the skirt is formed with a single outwardly projecting sealing formation which extends at least substantially continuously therearound, the sealing formation being a generally cylindrical land having an axial length of at least 2 mm, wherein axially of the piston the land is centered on the annular portion at its junction with the skirt.

12. A piston according to claim 1 wherein for making sealing engagement with the container bore the skirt is formed with a single outwardly projecting sealing formation which extends at least substantially continuously there around, the sealing formation being a generally cylindrical land having an axial length of at least 2 mm, wherein said land is dimensioned to make an interference of between 0.25 mm and 0.5 mm on diameter with the container bore.

13. A piston according to claim 1 wherein for making sealing engagement with the container bore the skirt is formed with a single outwardly projecting sealing formation which extends at least substantially continuously therearound, the sealing formation being a generally cylindrical land having an axial length of at least 2 mm, wherein said land is dimensioned to make an interference of about 0.375 mm on diameter with the container bore.

14. A piston according to claim 1 wherein for making sealing engagement with the container bore the skirt is formed with one or more outwardly projecting sealing formations which extend at least substantially continuously therearound, and wherein the sealing formations rise form a cylindrical outer surface of the skirt having transverse dimensions substantially corresponding to those of the container bore.

15. A piston according to claim 1 wherein for making sealing engagement with the container bore the skirt is formed with one or more outwardly projecting sealing formations which extend at least substantially continuously therearound, and wherein said sealing formations are partially or wholly interrupted by one or more grooves or interruptions formed therein.

16. A piston according to claim 1 wherein for making sealing engagement with the container bore the skirt is formed with one or more outwardly projecting sealing formations which extend at least substantially continuously therearound, and wherein said piston has a plurality of mutually spaced and outwardly projecting collecton and guidance formations formed on the skirt adjacent the backward end thereof for engagmeent with the container bore, said grooves or interruptions having said collection and guidance formations aligned therewith axially of the piston.

17. A piston according to claim 1 wherein in front of its attachment to the annular portion the skirt has a forward free edge which includes a forwardly and inwardly inclined lead-in surface to assist initial insertion of the piston within the container bore.

18. A piston according to claim 1 wherein the skirt has a stacking formation around its forward end which is dimensioned to fit snugly within the backward end of the skirt, whereby a stack may be formed of said pistons which are located stably in relation to one another by their said stacking formations.

19. A piston according to claim 1 wherein in front of its attachment to the annular portion the skirt has a forward free edge which includes a forwardly and inwardly inclined lead-in surface, and wherein the skirt has a stacking formation around its forward end which is dimensioned to fit snugly within the backward end of the skirt, and wherein the stacking formation projects forwardly from the inner periphery of the lead-in surface.

20. A thermoplastics piston for a pressure-dispensing container, which comprises a closure panel, and a tubular skirt which extends generally in a backward direction from integral attachment to the closure panel periphery and has an external sealing land which surrounds said integral attachment of said skirt with said closure panel in axial correspondence therewith and which is adpated to provide sealing and guidance for said piston by engagement with the bore of a said container in which said piston is received, wherein said closure panel has a central portion for receiving axially directed extrusion forces imposed on said piston for dispensing product from said container, and an annular portion connecting said central portion peripherally to said skirt, said central portion having a front face for contact with the product and being rigid so as to withstand said axially imposed extrusion forces and the resultant reaction forces of the product and without any substantial distortion thereof, said annular portion having a dimension radially of said piston substantially less than the corresponding dimension of said central portion, and said annular portion being inclined at an angle of from 45° to 70° to the piston axis and extending forwardly and outwardly towards said skirt so as to transmit said extrusion forces to said skirt with a radially outward component whereby said sealing land on said skirt may be expanded into tighter sealing engagement with said container bore.

21. A piston according to claim 20 wherein said sealng land has an axial length of from about 2 mm to 3.5 mm.

22. The piston according to claim 20 wherein said sealng band is provided with at least one peripheral groove formed therein for venting air therethrough.

* * * * *